US009120328B2

(12) United States Patent
Lindner

(10) Patent No.: US 9,120,328 B2
(45) Date of Patent: Sep. 1, 2015

(54) MARKING DEVICE FOR MARKING CONTAINERS, CONTAINER HANDLING DEVICE AND A METHOD FOR MARKING CONTAINERS

(71) Applicant: KRONES AG, Neutraubling (DE)

(72) Inventor: Peter Lindner, Langquaid (DE)

(73) Assignee: KRONES AG, Neutraubling (DE)

( * ) Notice: Subject to any disclaimer, the term of this patent is extended or adjusted under 35 U.S.C. 154(b) by 33 days.

(21) Appl. No.: 13/962,238

(22) Filed: Aug. 8, 2013

(65) Prior Publication Data

US 2014/0043421 A1 Feb. 13, 2014

(30) Foreign Application Priority Data

Aug. 13, 2012 (DE) ..... 10 2012 214 381

(51) Int. Cl.
*B41J 3/407* (2006.01)
*B41J 29/393* (2006.01)
*B07C 5/34* (2006.01)

(52) U.S. Cl.
CPC ..... *B41J 3/407* (2013.01); *B07C 5/3408* (2013.01); *B41J 3/4075* (2013.01); *B41J 29/393* (2013.01); *B07C 5/34* (2013.01); *B07C 5/3412* (2013.01)

(58) Field of Classification Search
CPC ..... B41J 3/407; B41J 3/4075; B41J 29/393; B07C 5/3408; B07C 5/34; B07C 5/3412
USPC ..... 347/106, 107, 19
See application file for complete search history.

(56) References Cited

U.S. PATENT DOCUMENTS 4,004,904 A * 1/1977 Fergusson ..... 65/158
4,459,487 A * 7/1984 Leser ..... 250/559.22
5,322,152 A * 6/1994 Tommila et al. ..... 194/212

(Continued)

FOREIGN PATENT DOCUMENTS

DE 2525919 A1 2/1976
DE 2653000 A1 8/1977
DE 3444225 * 6/1986 ..... G01M 3/24

(Continued)

OTHER PUBLICATIONS

Search Report dated Oct. 26, 2012 for DE102012214381.5.

*Primary Examiner* — Henok Legesse
(74) *Attorney, Agent, or Firm* — Marshall, Gerstein & Borun LLP

(57) ABSTRACT

The disclosure relates to a marking device for marking containers, for example, in the food industry, with devices for receiving measured feature data of a container and/or one or more container configurations, where the measured feature data is determined by a measuring device, and where the measured feature data relates to at least one criterion of several criteria which the container and/or the one or more container configurations do not satisfy. Furthermore, the marking device includes devices for creating marking data based on the measured feature data, where the marking data can be created such that it is indicated which of the several criteria the container and/or the one or more container configurations do not satisfy, and devices for physically applying at least one marking on the container, where the at least one marking is based on the marking data. The disclosure further relates to a container handling device with the marking device and a method for marking containers using the marking device.

14 Claims, 4 Drawing Sheets

| 24 Feature data | 23 Marking data: Type I–25 | Type II–26 |
|---|---|---|
| Closure missing | nc | |
| Closure fitted slanted | sc | |
| Filling level too low | lfl | |
| Fault in the bottom | b | |
| Fault in the side wall | sw | |
| Fault in the sealing surface | ss | |
| Label is missing | ml | |
| Label rotated by n° | rl (n °) | |
| Label offset by dx, dy | ol (dx, dy) | |

(56) References Cited

U.S. PATENT DOCUMENTS

| | | | | |
|---|---|---|---|---|
| 2006/0262180 | A1* | 11/2006 | Robbins | 347/257 |
| 2011/0172955 | A1 | 7/2011 | Herrmann et al. | |

FOREIGN PATENT DOCUMENTS

| | | | | | |
|---|---|---|---|---|---|
| DE | 3444225 | A1 | | 6/1986 | |
| DE | 29803507 | U1 | | 11/1998 | |
| DE | 19834185 | A1 | | 2/2000 | |
| DE | 10035651 | A1 | | 1/2002 | |
| DE | 10049404 | A1 | | 4/2002 | |
| EP | 1510809 | A1 | | 3/2005 | |
| EP | 1900446 | A2 | | 3/2008 | |
| GB | 1402857 | A | | 8/1975 | |
| GB | 1557461 | A | | 12/1979 | |
| GE | 1557461 | | * | 2/1976 | G05B 23/02 |
| WO | WO-0196041 | A1 | | 12/2001 | |
| WO | WO-2004044868 | A1 | | 5/2004 | |
| WO | WO-2010049153 | A1 | | 5/2010 | |
| WO | WO-2011030042 | A1 | | 3/2011 | |
| WO | WO-2012062449 | A1 | | 5/2012 | |

* cited by examiner

| 24 Feature data | 23 Marking data | |
|---|---|---|
| | Type I 25 | Type II 26 |
| Closure missing | nc | |
| Closure fitted slanted | sc | |
| Filling level too low | lfl | |
| Fault in the bottom | b | |
| Fault in the side wall | sw | |
| Fault in the sealing surface | ss | |
| Label is missing | ml | |
| Label rotated by n° | rl (n °) | |
| Label offset by dx, dy | ol (dx, dy) | |

FIG. 4

MARKING DEVICE FOR MARKING CONTAINERS, CONTAINER HANDLING DEVICE AND A METHOD FOR MARKING CONTAINERS

FIELD OF THE INVENTION

The disclosure relates to a marking device for marking containers according to the preamble of claim 1, a container handling device according to the preamble of claim 6, and a method for marking containers according to the preamble of claim 7.

BACKGROUND

Current prior art is, for example, that lead-out and/or distribution systems are in a bottling plant in the food industry arranged downstream of inspection units and/or machines, and lead inspected containers onto corresponding tracks depending on the respective inspection result. For example, underfilled containers can downstream of a filling machine be led to a lead-out belt. It is also possible, however, that several different inspection results are led out to a common belt, such as underfilled and/or incorrectly closed containers. Containers having two different types of faults and also faulty rejections are therefore then found in a separation station. In extreme cases, it can happen that it is not apparent which type of fault is given, or whether a malfunction or contamination of the inspection device resulted in the lead-out of the container when the container actually has no fault.

The published patent application DE 26 53 000 discloses a device for marking selected objects in a block of objects moving in rows along a conveyor belt and being disposed transversely to the conveyor belt in batches. A plurality of marking units is arranged transversely above the conveyor belt, and each of them is mounted vertically above one of these rows of objects. The marking unit can receive signals to mark one of the selected objects appearing below the marking unit. The marking medium is preferably paint that is non-toxic and preferably reflective.

GB 1 402 857 discloses a marking system for marking defective items, so that they can be easily distinguished from similar items that are not defective. A marking can be applied onto a container using a marking unit, for which purpose, for example, ink or other marking fluid is used. Marked defective containers can be detected either by an automatic inspection device or by manual inspection.

WO 2011/030 042 A1 discloses a method in which objects matching a criterion are assigned an identifier "1", and objects not matching the criterion are assigned an identifier "0". The identifier is to assist in manually sorting out the identified objects not matching the criterion. In this, placement of the visual identifier does not occur physically on the object because a physical mark could, for example, damage the object or adhere poorly to the object. For example, a visual identifier can be such that a light beam is projected onto the identified objects not matching the criterion.

DE 198 34 185 A1 discloses a method for inspecting container closures, where when applying the closures an internal pressure characteristic is measured and/or parameters of the closures or the containers are detected, the knowledge of which is necessary for determining the internal pressure from the measurement of the internal pressure characteristic. Allocation of the values measured or detected when mounting the closures to the respective container is possible by marking.

For example, the measured values of the characteristic and the parameters can with the marking be directly applied to the container.

The disclosure is therefore based on the objective to provide a marking device which allows creating markings and applying them to/onto a container, so that also non-evident faults on or at the containers or faults associated with a container can be allocated. It is a further objective of the disclosure to provide a container handling device with the marking device and an improved method for marking containers using the marking device.

SUMMARY

According to some aspects, one or both of these objectives is satisfied by the marking device according to claim 1, the container handling device according to claim 6, and the method according to claim 7. Preferred embodiments are covered by the dependent claims.

The marking device for marking containers, for example, in the food industry includes devices for receiving measured feature data of a container and/or one or more container configurations, such as a label and/or a closure, where the measured feature data is determined by a measuring device and where the measured feature data relates to at least one criterion of several criteria which the container and/or the one or more container configurations do not satisfy. Furthermore, the marking device includes devices for creating marking data based on the measured feature data, where the marking data can be created such that it is indicated which of the several criteria the container and/or the one or more container configurations do not satisfy, and devices for physically applying at least one marking onto the container, where the at least one marking is based on the marking data.

Measured feature data can comprise the presence of contamination and/or faults in the bottom and/or side wall of a container or the presence of surface wear. The one position or the several positions can be comprised in the feature data at which contamination, a fault and/or wear has been detected, i.e. has been measured in the determination of the feature data. In addition, the measured feature data can comprise information as to whether a defined filling level of the container has been reached, whether a label is present, and whether the label is attached in the right position and/or with the correct orientation to the container, whether the closure of the container is fitted properly, or whether there is any foreign material in the contents of the container. For example, when a label has been applied incorrectly, information can be included in the feature data indicating the measured position regarding the incorrectly placed label. Furthermore, the measured feature data can include information as to whether variable data applied to a container, such as an expiration date and/or time, is disposed in the right location and/or is readable.

The containers can be bottles and/or beverage containers made of glass, PET, or other material, or cans or the like.

The devices for applying the marking can comprise a laser printer, an inkjet printer, a label and/or a UV-ink printer. This type of marking has the advantage that the output data which is reproduced by the marking can be read directly from the container by a user or a read-out device. This is advantageous if a direct overview of the faults of the containers led out is to be gathered. In addition, UV-ink is advantageous for printing onto non-absorbent materials, such as glass and plastic. UV-ink, in addition to color pigments and photoinitiators, contains individual molecules and short molecular chains that can be chained together to form polymers. The photoinitiators decompose upon irradiation with UV-light forming radicals that trigger a polymerization process, resulting in the creation of solid, three-dimensional mesh structures.

The laser printer, the inkjet printer and/or the UV-ink printer can be adapted to print directly onto the container, or they can be adapted to print onto the label prior to or after the label has been applied to the container. Selection of the printing method can, for example, depend on a material of the container and/or its shape.

The devices for creating the marking data can, for example, comprise at least one data processing program which is adapted to process the received feature data to marking data. The feature data generally includes information as to which criterion or criteria a container does not satisfy. In addition to this information, for example, values can also be included as to how much deviation from the criterion is given. For example it can be stated that a filling level is 2% lower than the target filling level, or that a label is rotated by 3° off the target position. In addition, the feature data can also include information as to which preform machine, blow molding machine, filling station, sealing station, or labeling machine, or which handling organ the container arrives from.

The devices for receiving the measured feature data can be an interface that is preferably adapted such that it can receive measured feature data from various measuring devices. In this, it is advantageous if, for example, measurements are performed downstream of a preform machine, blow molding machine, filling station, sealing station, inspection machine and/or labeling machine. It is then possible, that the marking device receives the respectively measured feature data via the receiving devices. Thereby, a respective marking device does not need to be provided for each of the various measuring devices.

A container handling device, such as a preform machine, a blow molding machine, a filling station, a sealing station, an inspection machine, or a labeling machine, includes the marking device according to the disclosure for marking containers, whereby it is possible to mark containers in such a manner that, for example, an overview can be obtained in a lead-off station as to which of the containers, being sorted out and marked, exhibit what fault.

A method for marking containers using the marking device according to the disclosure includes receiving measured feature data of a container and/or one or more container configurations by the receiving devices where the measured feature data is determined by a measuring device and where the measured feature data relates to at least one criterion of several criteria not satisfied by the container and/or the one or more container configurations. Furthermore, the method includes creation of marking data by the device for creating marking data based on the measured feature data, where the marking data is created such that it is indicated which of the several criteria the container and/or the one or more container configurations do not satisfy, and a physical application of at least one marking onto the container by the device for the physical application, where the at least one marking is based on the marking data.

The at least one criterion can relate to faults regarding the bottom, side walls and/or sealing surface of the container, surface wear of the container, filling level, placement of the closure, application of the label and/or foreign material in the container.

For measuring the feature data, the container can be transported through the measuring device together with the one or more container configurations—if any—and at least one feature of the container and/or of the one or more container configurations—if any—is measured. If there is no container configuration at and/or on the container, then only the feature data of the container is measured.

At least one criterion can be predetermined for the measurement, where the measured feature data is compared with the at least one criterion to be able to determine whether the container and/or the one or more container configurations satisfy all criteria or whether one of the criteria is not satisfied. By predetermining the at least one criterion, a sorting-out of containers based on the failure to satisfy a criterion can be varied. For example, a criterion relating to the surfaces wear of the container can be adapted such that a certain number of containers are sorted out. In this manner, e.g. a scrap rate of 1.2% of the containers or more or less can be achieved.

Furthermore, the method can comprise a step of leading out the container and communicating the measured feature data of the container to the device for receiving of the marking device when the container does not satisfy at least one of the criteria.

Moreover, the marked containers can be transported to a lead-out station. Thereby, an overview can be obtained as to which of the containers being sorted out and marked have which faults. For example, it is possible to re-use containers with a filling level being too low, an incorrectly applied label, or an incorrectly fitted closure in a new filling process, whereas containers with faults or damage to the bottom, side walls and/or sealing surfaces can be excluded from another filling process.

Further advantages and embodiments result from the accompanying drawings:

BRIEF DESCRIPTION OF THE DRAWINGS

FIG. 4 shows tabulated feature data and allocated marking information.

DETAILED DESCRIPTION

Figure 1:
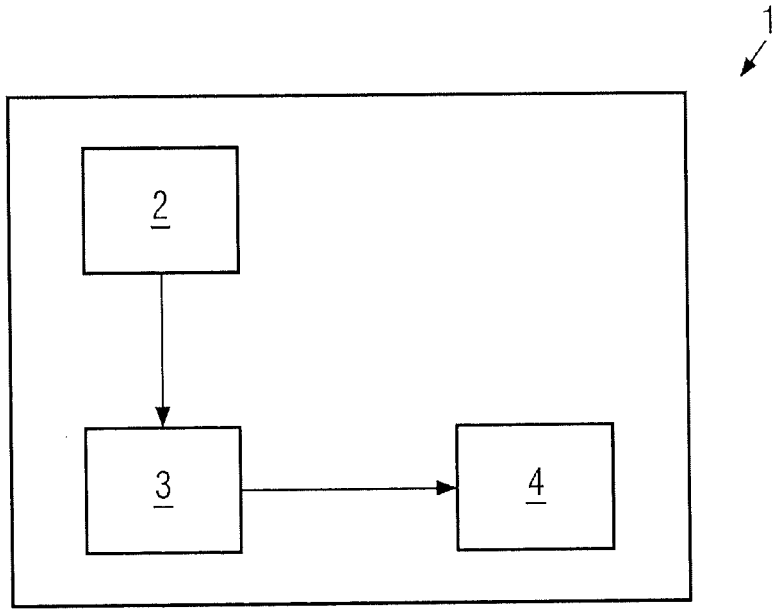
FIG. 1 shows a schematic illustration of the marking device.

FIG. 1 schematically shows a marking device 1 for marking containers, for example, in the food industry. The marking device 1 includes devices for receiving 2 measured feature data of a container and/or one or more container configurations, where the measured feature data is determined by a measuring device and where the measured feature data relates to at least one criterion not satisfied by the container and/or the one or more container configurations. Moreover, the marking device 1 includes devices for creating 3 marking data based on the measured feature data, and devices for the physical application 4 of a marking onto the container, where the at least one marking is based on the marking data.

The devices for creating 3 marking data can comprise data processing programs processing the received feature data such that marking data is obtained. The marking data can e.g. be control commands for the devices for physically applying 4 the marking, so that at least one marking according to the control commands can be applied onto the container.

The devices for receiving 2 can be an interface or gateway via which the marking device 1 can communicate with the measuring device. The devices for receiving 2 are here preferably adapted such that they can receive measured feature data from various measurement devices. It is advantageous if, for example, measurements are performed downstream of a preform machine, blow molding machine, filling station, sealing station, inspection machine or labeling machine. It is then possible that the marking device 1 receives the respective measured feature data via the devices for receiving 2. Thereby, a respective marking device 1 does not need to be provided for each of the various measuring devices.

The device for physically applying 4 the at least one marking can include a laser printer, an inkjet printer, a label and/or a UV-ink printer. By using the printer, the at least one marking can be printed directly onto a container. The at least one marking, however, can previously also be printed onto a label, and this label is then applied to the container.

Figure 2:
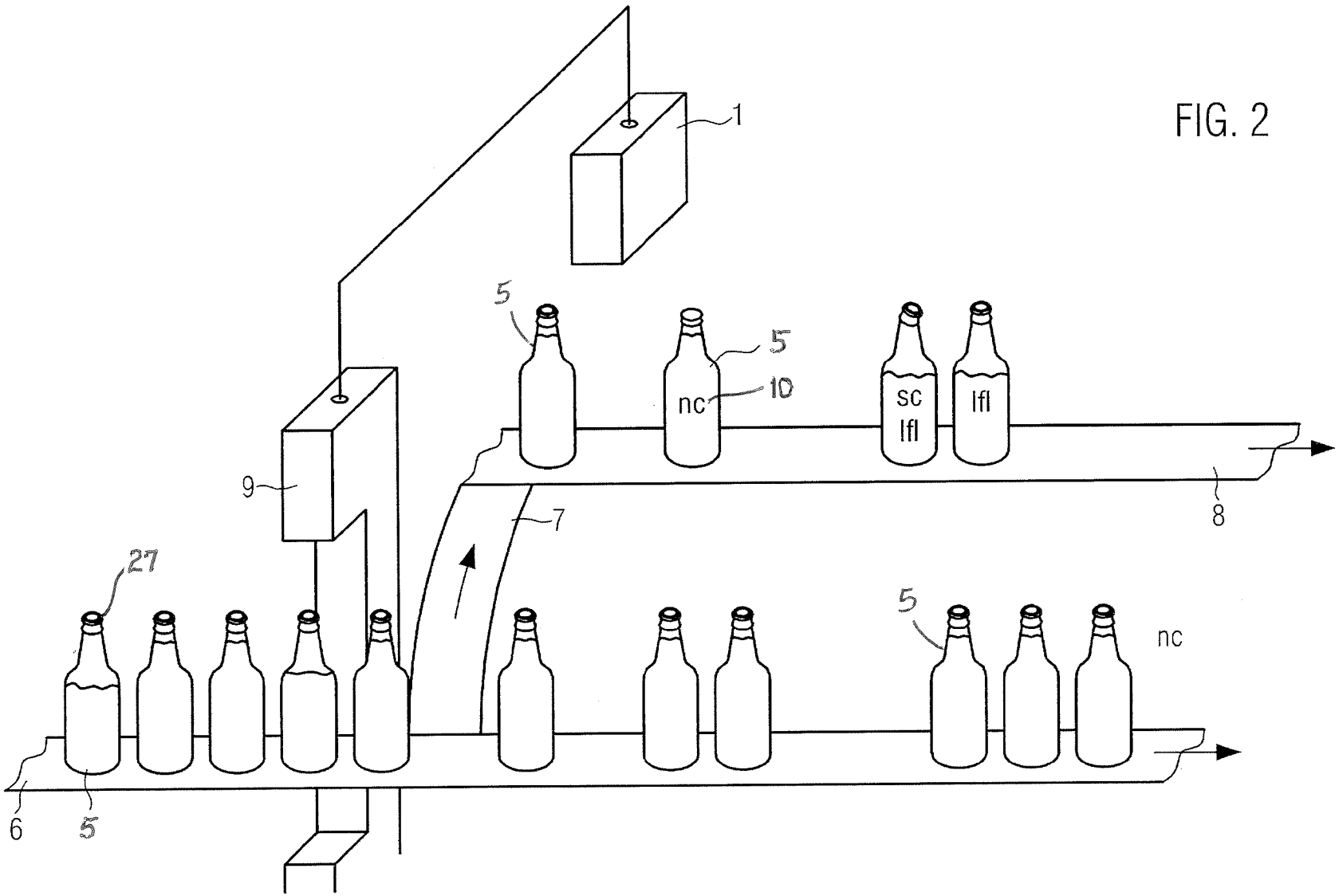
FIG. 2 shows a schematic illustration of a part of an industrial installation with a measuring device and a marking device, and with unmarked and marked containers.

FIG. 2 schematically shows a part of an industrial installation in which containers 5 are conveyed on conveyor belts 6, 7, 8. The containers 5, presently by way of example shown as bottles, are first conveyed sequentially through a measuring device 9, in which one or more features of a container 5 and/or one or more container configurations are measured simultaneously or successively to be able to determine whether the containers 5 and/or that one or more container configurations satisfy a predetermined criterion or several predetermined criteria. The containers 5 shown in FIG. 2 include closures 27 as container configuration.

Such a criterion can be, for example, a filling level of the container 5, which should not be below a minimum value and not exceed a maximum value. If the measured filling level (i.e. the measured characteristic of the container 5) is located within the range between the minimum and maximum value, then the container 5 satisfies the criterion. If the measured filling level (i.e., the measured characteristic of the container 5) is located outside the range between the minimum and maximum value, then the container 5 does not satisfy the criterion. In this case, at least one marking 10 should then be applied to this container 5 by the marking device 1. The measuring device 9 schematically shown in FIG. 2 additionally measures whether the closure 27 of a container 5 is present and if so, whether it is fitted correctly. This can, for example, be done by a comparison of the silhouette of a correctly closed container with the actual silhouette of the measured container 5.

If it is determined during the measuring by the measuring device 9 that a container 5 and/or the one or more container configurations satisfy all criteria, then the container 5 remains on a first conveyor belt 6 and is conveyed on so that it is not conveyed along under the marking device 1. If it is determined, however, that a container 5 and/or the one or more container configurations do not satisfy at least one criterion, then the container 5 is via the lead-out belt 7 led out, and via a second conveyor belt 8 arrives at the marking device 1.

With the device for receiving 2, the marking device 1 receives the feature data of the container 5 and/or the one or more container configurations measured by the measuring device 9 and generates marking data therefrom. Data transfer can be effected in a wireless or in a wired manner. The at least one marking 10 is then physically applied to the container 5, where the at least one marking is based on the marking data.

The marked container 5 can be conveyed by the second conveyor belt 8, for example, to a lead-out station, so that a user of the industrial installation can gather an overview of how many containers 5 having which faults were led out. Easy and unambiguous allocation of faults is possible with the markings 10 applied to the containers 5.

Figure 3:
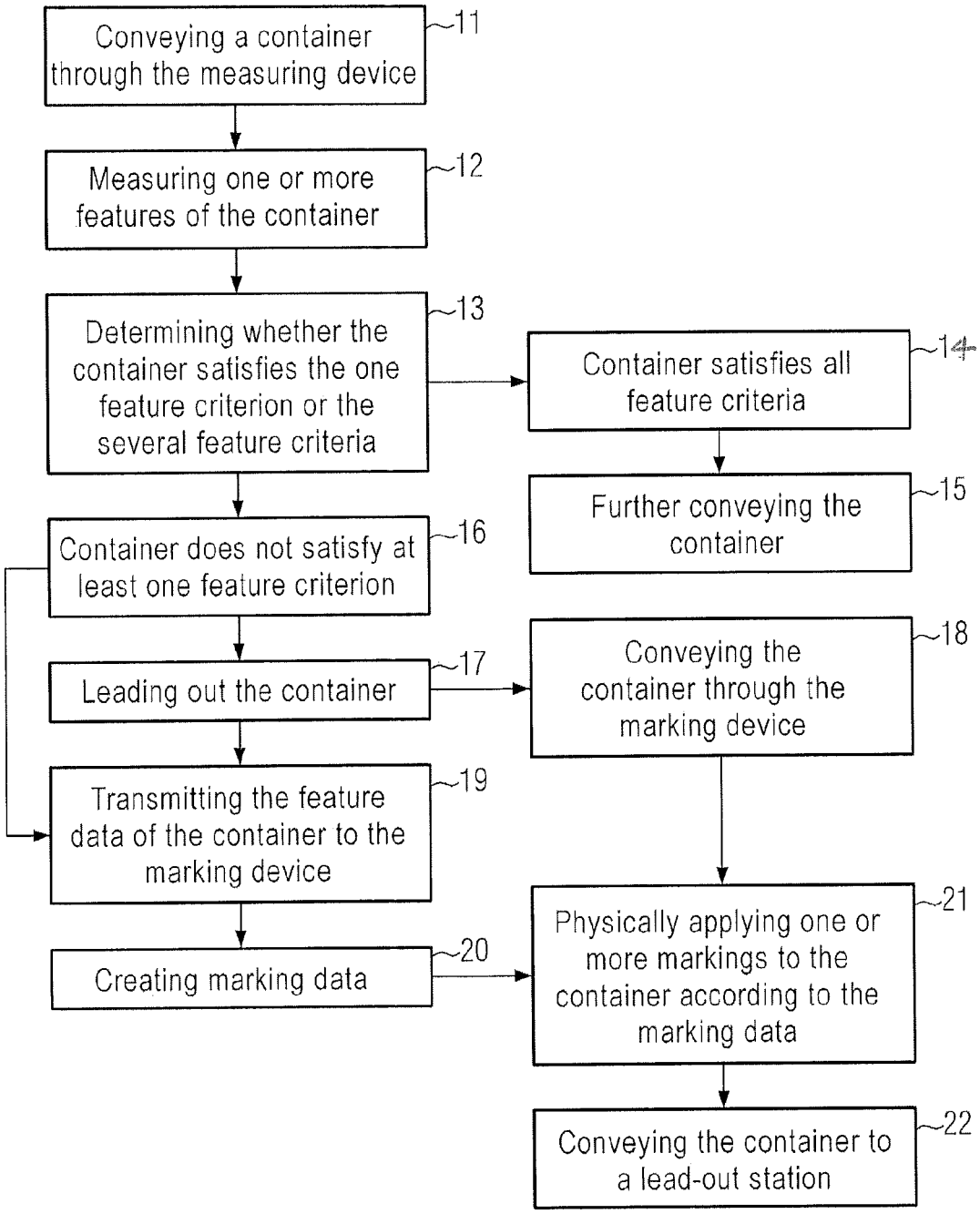
FIG. 3 shows a flowchart of a method for marking a container.

FIG. 3 shows a flowchart of a method for marking a container using a marking device 1 described above. In a filling station of an industrial installation, generally many containers 5 are conveyed on conveyor belts or the like through the various machines and also through measuring devices 9. The method is for the sake of clarity described below for only one container 5.

In step 11, the container 5 is conveyed, for example, by a first conveyor belt 6 through a measuring device 9. In this, the measuring device 9 is arranged such that it can take a measurement from above, from the side, or from below the container 5, depending on the feature of the container 5 and/or the one or more container configurations to be measured. In step 12, one feature can be measured when taking a measurement, or several features of the container 5 and/or the one or more container configurations can be measured simultaneously or successively.

Such a measuring device 9 can measure, for example, the bottom, the side walls and the sealing surface of the container 5 in order to determine that one or more faults exist (i.e. the container 5 does not satisfy one criterion or several criteria and is to be marked), or that there are no faults (i.e. the container 5 satisfies the one criterion or the several criteria and does not need to be marked). If one or more faults exist, then the feature data measured by the measuring device 9 can also comprise the one position or the several positions at which a contamination, a fault and/or a wear has been detected.

Another measuring device 9 can measure, for example, the filling level and the closure 27 of the container 5 in order to determine that the filling level and the closure are correct (i.e. the container 5 and the closure (a container configuration) satisfy the criteria, and therefore the container 5 does not need to be marked) or that the filling level and/or the closure are not correct (i.e. the container 5 and/or the closure do not satisfy one criterion or several criteria and the container 5 is therefore to be marked). If, for example, the filling level is not correct, then the feature data measured by the measuring device 9 can comprise the values of the measured filling level.

In another measuring device 9, for example, application of the label (a container configuration) can be measured. It can be measured whether the label is mounted in a correct position, whether it is rotated about an angle and/or shifted by dx and/or dy; dx and dy here represent displacements in the x and y directions.

Another measuring device 9 can measure the positioning and/or the readability of variable data applied on a container, such as the expiration date and/or the time. If an incorrect positioning is detected during the measuring, then the measured feature data can comprise information regarding the position of the variable data wrongly applied.

The method is described below for a measuring device 9 measuring the filling level and the closure 27 of the container 5. Thereby, a pre-filled and closed container 5 is in step 11 conveyed via the first conveyor belt 6 through the measuring device 9. The measuring device 9 in step 12 first measures, for example, the filling level of the container 5. In order to determine in step 13 whether or not the filling level is correct or not, the measured value of the filling level can be compared with a predetermined minimum value and a predetermined maximum value.

If the measured value of the filling level is located within the so predetermined range, the filling level is correct and the container 5 satisfies the criterion. If the measured value of the filling level is located outside the so predetermined range, the filling level is not correct and the container 5 does not satisfy the criterion.

Furthermore, the measuring device 9 in step 12 measures the closure 27 of the container 5. If the closure 27 is fitted properly and closes the container 5, then the container configuration satisfies the criterion. If the closure 27 is not fitted correctly and/or does not properly close the container 5, then the container configuration does not satisfy the criterion.

If it is determined in step 14 that the container 5 and the container configuration satisfy all criteria (feature criteria), presently the correct filling level and the properly fitted closure, then the container 5 is in step 15 further conveyed, for example, via the first conveyor belt 6.

If it is determined in step 16 that the container 5 and/or the container configuration do not satisfy at least one of the criteria (feature criteria), presently no correct filling level and/or closure 27 not properly fitted, then the container 5 is in step 17, for example, led out via the lead-out belt 7. If the container 5 is led out for not satisfying a criterion or both criteria, then it is in step 18 conveyed via the second conveyor belt 8 through a marking device 1. Furthermore, the feature data of the container 5 is in step 19 transmitted from the measuring device 9 to the marking device 1. The marking data for the container 5 is in step 20 created by the devices for creating 3 marking data.

The physical application of the at least one marking based on the marking data of the container 5 is in step 21 performed by the devices for physically applying 4 of the marking device 1. When the container 5 is marked, it can be conveyed via the second conveyor belt 8, for example, to a lead-out station in which the led-out containers 5 are collected.

FIG. 4 by way of example shows two types of marking data 23, which can be used to represent certain measured feature data 24 of a container 5 and/or one or more container configurations. In type I 25, characters are used as marking data 23, which represent a kind of abbreviation of the feature data 24, whereby an applied marking 10 allows an unambiguous allocation of the measured feature data 24. For example, "nc" ("n"o "c"losure) can be allocate to the feature data 24 "closure missing", "sc" ("s"lanted "c"losure) to the feature data 24 "closure fitted slanted", "lfl" ("l"ow "f"illing "l"evel) to the feature data 24 "filling level too low", "b" ("b"ottom) to the feature data "fault in the bottom", "sw" ("s"ide "w"all) to the feature data 24 "fault in the side wall", "ss" ("s"ealing "s"urface) to the feature data 24 "fault in the sealing surface", and "ml" ("m"issing "l"able) to the feature data 24 "label is missing".

If a label is available, but rotated, for example, at an angle n° relative to a predefined orientation, the fault indication in the marking data 23 can also comprise the angle value n°, so that a marking 10 indicates "rl (n°)". The marking data 23 "rl (n)°)" ("r"otated "l"abel) can therefore be allocated to the feature data 24 "label rotated by n°".

If a label of a container is applied offset in the x-direction and/or in the y-direction (the coordinate system on the surface of the container onto which the label has been applied), relative to a pre-determined orientation, then the values dx, dy of the offset are indicated in the marking data 23. The marking data 23 "ol (dx, dy)" ("o"ffset "l"abel) can therefore be allocated to the feature data 24 "label offset by dx, dy".

In type II 26, the measured feature data 24 is presented in a stylized rectangle, so that a user observing the marking or the markings 10 on the container 5 can realize which fault or faults the container 5 exhibits. For example, a fault in a side wall of the container 5 can be visualized in that the vertical side lines of the rectangle are marked bold and/or in color. If a label is applied onto the container 5 offset by dx, dy, then this can be visualized by a cross arrow in a rectangular label within the rectangle.

The marking data can also be encoded using a two-dimensional bar code and the marking 10 can be applied as a bar code or a QR® code onto the container 5. Such codes can be read and decoded by a reading device, so that the marking data stored in the code become accessible, and it can be determined why a container was led out.

The above embodiments relate in particular to the configurations defined in the claims and represent the specific device features of the claimed configurations, so that the relationship of the terminology is used across the embodiments as well as the claims. In addition, the embodiments, their features and combinations of features represent examples of the embodiments in the claims and do not restrict the claims, but serve to illustrate them.

The present disclosure is described using the specification and the drawings by way of examples, though not restricted thereto, but includes all variations, modifications, substitutions and combinations that the person skilled in the art can gather from the present documents, including the claims, the general explanations in the introduction to the specification, the practical examples in the specification, and the corresponding illustrations in the figures. In particular, all individual features and options of the embodiments of the disclosure can be combined with each other.

What is claimed is:

1. A marking device for marking containers, said marking device comprising:

at least one device for receiving measured feature data of a container and/or one or more container configurations, where said measured feature data is determined by a measuring device, where the measured feature data has been compared with at least one predetermined criterion, and where said received measured feature data relates to at least one criterion of several predetermined criteria that said container and/or said one or more container configurations do not satisfy in that the measured feature fails to satisfy the at least one predetermined criterion;

at least one device for creating marking data based on the received measured feature data, where said marking data represents the received measured feature data in order to indicate by said marking data which of said several predetermined criteria said container and/or said one or more container configurations do not satisfy; and at least one device for physically applying at least one marking onto said container, where said at least one marking is based on said marking data, and the at least one applied marking data allows an unambiguous allocation of the received measured feature data;

wherein said at least one criterion relates to at least one of: faults regarding bottom side walls and/or sealing surface of said container; surface wear of said container; filling level; placement of the closure; application of the label; and foreign material in said container.

2. The marking device according to claim 1, where said device for physically applying said at least one marking comprises at least one of a group including a laser printer, an inkjet printer, a label, and a UV-ink printer.

3. The marking device according to claim 2, where said laser printer, said inkjet printer, and/or said UV-ink printer print directly onto said container.

4. The marking device according to claim 2, where said laser printer, said inkjet printer, and/or said UV-ink printer print onto a label prior to or after said label has been applied to said container.

5. The marking device according to claim 1, where said device for creating said marking data comprises at least one data processing program which is processes the received feature data to marking data.

6. The marking device according to claim 1, where said device for receiving said measured feature data comprises an interface.

7. Container handling device comprising a marking device for marking containers according to claim 1.

8. The container handling device according to claim 7, wherein the container handling devices comprises at least one of a preform machine, a blow molding machine, a filling station, a sealing station, an inspection machine, and a labeling machine.

9. A method for marking containers using a marking device according to claim 1, where said method comprises the steps of:

receiving measured feature data of the container and/or the one or more container configurations by said devices for receiving measured feature data, where said measured feature data is determined by the measuring device, where the measured feature data has been compared with at least one predetermined criterion and where said received measured feature data relates to at least one criterion of several predetermined criteria that said container and/or said one or more container configurations do not satisfy in that the measured feature data fails to satisfy the at least one predetermined criterion;

creating marking data based on said measured feature data by said device for creating marking data, where said marking data is created that represents the received measured feature data in order to indicate by the marking data which of said several predetermined criteria said container and/or said one or more container configurations do not satisfy; and physically applying the at least one marking onto said container by said device for physically applying, where said at least one marking is based on said marking data, and the at least one applied marking data allows an unambiguous allocation of the received measured feature data;

wherein said at least one criterion relates to at least one of: faults regarding bottom, side walls and/or sealing surface of said container; surface wear of said container; filling level; placement of the closure; application of the label; and foreign material in said container.

10. The method according to claim 9, wherein said container is for measuring said feature data conveyed through said measuring device, and at least one feature of said container and of said one or more container configurations is measured.

11. The method according to claim 10, wherein said measured feature data is compared with said at least one criterion of the several predetermined criteria in order to determine whether said container and/or said one or more container configurations satisfy all criteria or whether said container and/or said one or more container configurations do not satisfy at least one of said criteria.

12. The method according to claim 11, further comprising the steps of:

leading out said container; and communicating said measured feature data of said container and/or said one or more container configurations to said devices for receiving of the marking device when said container and/or said one or more container configurations do not satisfy at least one of said criteria.

13. The method according to claim 9, further comprising the step of conveying said marked container to a lead-out station.

14. The marking device according to claim 1, wherein the container configurations comprise a label and closure.

* * * * *